US010270179B2

(12) United States Patent
Lee et al.

(10) Patent No.: US 10,270,179 B2
(45) Date of Patent: Apr. 23, 2019

(54) BEAM-STEERING SYSTEM OF HIGH-GAIN ANTENNA USING PARAELECTRIC MATERIAL

(71) Applicant: Hongik University Industry-Academia Cooperation Foundation, Seoul (KR)

(72) Inventors: Jeong-Hae Lee, Seoul (KR); Jae-Gon Lee, Gwangmyeong-si (KR)

(73) Assignee: Hongik University Industry-Academia Cooperation Foundation, Seoul (KR)

( * ) Notice: Subject to any disclaimer, the term of this patent is extended or adjusted under 35 U.S.C. 154(b) by 109 days.

(21) Appl. No.: 15/202,512

(22) Filed: Jul. 5, 2016

(65) Prior Publication Data

US 2017/0373399 A1 Dec. 28, 2017

(30) Foreign Application Priority Data

Jun. 28, 2016 (KR) ..... 10-2016-0080746

(51) Int. Cl.

| | |
|---|---|
| ***H01Q 1/36*** | (2006.01) |
| ***H01Q 1/48*** | (2006.01) |
| ***H01Q 3/24*** | (2006.01) |
| ***H01Q 3/46*** | (2006.01) |
| ***H01Q 13/10*** | (2006.01) |
| ***H01Q 15/14*** | (2006.01) |

(52) U.S. Cl.

CPC ..... *H01Q 13/106* (2013.01); *H01Q 1/36* (2013.01); *H01Q 1/48* (2013.01); *H01Q 3/24* (2013.01); *H01Q 3/46* (2013.01); *H01Q 15/147* (2013.01)

(58) Field of Classification Search

CPC .... H01Q 3/44; H01Q 15/002; H01Q 15/0026; H01Q 15/006; H01Q 15/147; H01Q 13/106

See application file for complete search history.

(56) References Cited

U.S. PATENT DOCUMENTS

| | | | | |
|---|---|---|---|---|
| 6,184,825 | B1 | 2/2001 | Wehner et al. | |
| 8,421,684 | B2 | 4/2013 | Livneh et al. | |
| 2006/0038634 | A1 * | 2/2006 | Kirino ..... | H01P 1/181 333/164 |

(Continued)

FOREIGN PATENT DOCUMENTS

| | | | |
|---|---|---|---|
| KR | 10-0586705 | B1 | 6/2006 |
| KR | 10-0963233 | B1 | 6/2010 |

(Continued)

*Primary Examiner* — Daniel Munoz
(74) *Attorney, Agent, or Firm* — Revolution IP, PLLC

(57) ABSTRACT

A beam steering system of a high-gain antenna includes an antenna configured to include a printed circuit board in which an antenna element is designed, and a ground plane, wherein the printed circuit board and the ground plane may be each adhered onto upper and lower surfaces of the antenna; a paraelectric material configured to be separated from the upper surface of the antenna with a predetermined distance and is divided into a plurality of cells, whose relative permittivity varies depending on a voltage applied to a pair of thin metallic conductor patches adhered to upper and lower surfaces of each cell; and a power supply unit configured to supply the voltage to the pair of thin metallic conductor patches which are each adhered to the upper and lower surfaces of the cell to face each other.

8 Claims, 6 Drawing Sheets

(56) References Cited

U.S. PATENT DOCUMENTS

| | | | | |
|---|---|---|---|---|
| 2011/0128202 | A1* | 6/2011 | Ju | H01Q 1/38 343/767 |
| 2011/0148704 | A1* | 6/2011 | Kim | H01Q 15/02 342/368 |
| 2011/0163930 | A1* | 7/2011 | De Lustrac | H01Q 15/148 343/777 |
| 2013/0222200 | A1* | 8/2013 | Ju | H01Q 15/02 343/833 |

FOREIGN PATENT DOCUMENTS

| | | | |
|---|---|---|---|
| KR | 10-1022237 | B1 | 3/2011 |
| KR | 10-2015-0062734 | A | 6/2015 |

* cited by examiner

BEAM-STEERING SYSTEM OF HIGH-GAIN ANTENNA USING PARAELECTRIC MATERIAL

CROSS-REFERENCE TO RELATED APPLICATION

This application claims priority to and the benefit of Korean Patent Application No. 10-2016-0080746, filed in the Korean Intellectual Property Office on Jun. 28, 2016, the entire contents of which are incorporated herein by reference.

BACKGROUND OF THE INVENTION

(a) Field of the Invention

The present disclosure relates to a system of a beam-steering system of a high-gain antenna using a paraelectric material. More particularly, the present disclosure relates to a beam-steering system of a high-gain antenna which controls a phase of a transmitted radio wave by using a paraelectric material whose relative permittivity varies depending on an applied voltage.

(b) Description of the Related Art

A microstrip patch antenna is a type of planar antenna which is fabricated in the form of a printed circuit board (PCB). This antenna is appropriate for mass-production, and is very solid due to its planar structure with a very low profile. Due to these advantages, the microstrip patch antenna has been used as an element of an array antenna which consists of a number of small antennas.

The array antenna has been commonly used to solve a problem of low gain that the microstrip patch antenna has. However, as the number of antennas increases, the power supply structure becomes more complicated. Particularly, in the millimeter wave band such as 5G mobile communication, loss of the power supply lines may also increase. For this reason, a technology capable of increasing the gain without increasing the number of antennas is required.

Conventionally, there was only two technologies in increasing the gain: one is a superstrate antenna technology using a dielectric material, and the other is a single antenna technology using a partially reflective surface (PRS), in which the gain increases only to a zenith direction. Therefore, an electrical beam steering technology capable of increasing the gain in the single antenna should be developed.

In addition, in the 5G mobile communication, a wide bandwidth is an essential factor to increase channel capacity and data throughput, and there has been growing interest in the potential of the millimeter-wave communication because considerable spectrums exist in the millimeter wave band. However, transmission in the millimeter-wave communication may bring serious path loss. Accordingly, a base station antenna should be complemented with a beam steering antenna with higher gain to compensate the path loss.

Korean Patent Publication No. 10-0963233 (published on Jun. 10, 2010) discloses a background technique of the present disclosure.

SUMMARY OF THE INVENTION

The present invention has been made in an effort to provide a beam-steering system of a high-gain antenna which controls a phase of a transmitted radio wave by using a paraelectric material whose relative permittivity varies depending on an applied voltage.

To accomplish the objects of the present disclosure, an exemplary embodiment of the present disclosure provides a beam steering system of a high-gain antenna, which may include: an antenna including a printed circuit board in which an antenna element is designed, and a ground plane, which are each adhered onto upper and lower surfaces of the antenna; a paraelectric material which is separated from the upper surface of the antenna with a predetermined distance and is divided into a plurality of cells, whose relative permittivity varies depending on a voltage applied to a pair of thin metallic conductor patches adhered to upper and lower surfaces of each cell; and a power supply unit which supplies the voltage to the pair of thin metallic conductor patches which are each adhered to the upper and lower surfaces of the cell to face each other.

The power supply unit may calculate a transmission phase corresponding to a desired beam steering angle of the antenna, select a relative permittivity of the paraelectric material by using the calculated transmission phase, and supply a voltage corresponding to the selected relative permittivity to at least one cell.

Transmission phases for the plurality of cells may be calculated by the following equation:

$$\begin{cases} \psi_{T1} = \psi_1 = \frac{\pi}{\lambda} p\sin\theta + \frac{\psi_N}{2} \\ \psi_{T-1} = \psi_{-1} = -\frac{\pi}{\lambda} p\sin\theta + \frac{\psi_N}{2} \end{cases}, \begin{cases} \psi_{T2} = \frac{2\pi}{\lambda} p\sin\theta - \phi_2 + \psi_1 \\ \psi_{T-2} = -\frac{2\pi}{\lambda} p\sin\theta - \phi_{-2} + \psi_{-1} \end{cases},$$

where $\psi_{T1}$ and $\psi_{T-1}$ are transmission phases for firstly arranged cells to the right and left from the center of the antenna, $\lambda$ is a wavelength of a operating frequency of the antenna, p is a distance between the center of one cell and the center of the adjacent cell, and $\theta$ is a beam steering angle, $\psi_N$ is a sum of $\psi_1$ and $\psi_{-1}$, $\psi_{T2}$ and $\psi_{T-2}$ are transmission phases for secondly arranged cells to the right and left from the center of the antenna, $\phi_2$ and $\phi_{-2}$ and are reflection phases for the secondly arranged cells.

In addition, transmission phases for the 2n+1-th ("n" is a natural number) arranged cells to the right and left from the center of the antenna may be set to be equal to the transmission phases $\psi_{T1}$ and $\psi_{T-1}$ for the firstly arranged cells, and transmission phases for the 2n+2-th arranged cells to the right and left from the center of the antenna may be set to be equal to the transmission phases $\psi_{T2}$ and $\psi_{T-2}$ for the secondly arranged cells.

The antenna may have a flat circular shape or a flat polygonal shape and may be separated from the paraelectric material with a distance within a half wave of the operating frequency. The printed circuit board may be designed so that one or more antenna elements are arranged therein.

The thin metallic conductor patches may be formed of silver (Ag).

The plurality of cells may have the same length and width, and may be separated from each other with the same interval therebetween.

Further, the plurality of cells, divided from the paraelectric material, may be formed along a length direction or formed like a lattice.

The pair of thin metallic conductor patches may be each adhered to the upper and lower surfaces of each cell after their thicknesses are set so that a reflection coefficient of each cell converses on 1 or a predetermined pattern is inserted therebetween.

According to the exemplary embodiment of the present disclosure, since relative permittivity can be controlled by using the paraelectric material whose permittivity varies depending on the applied voltage, phase control of a transmitted radio wave becomes possible, and therefore beam steering of a desired direction can be accomplished. Further, antenna gain can be enhanced by using a partially reflective surface (PRS).

Further, according to the exemplary embodiment of the present disclosure, depending on how the thin film shaped metallic conductor patches are arrayed, the 3-dimensional beam steering as well as the 2-dimensional beam steering becomes possible.

Furthermore, according to the exemplary embodiment of the present disclosure, since the beam steering utilizes characteristics of the paraelectric material, a number of antennas are not required, and the power supply structure is simplified, thereby decreasing loss of power supply lines.

DETAILED DESCRIPTION OF THE INVENTION

Figure 1:
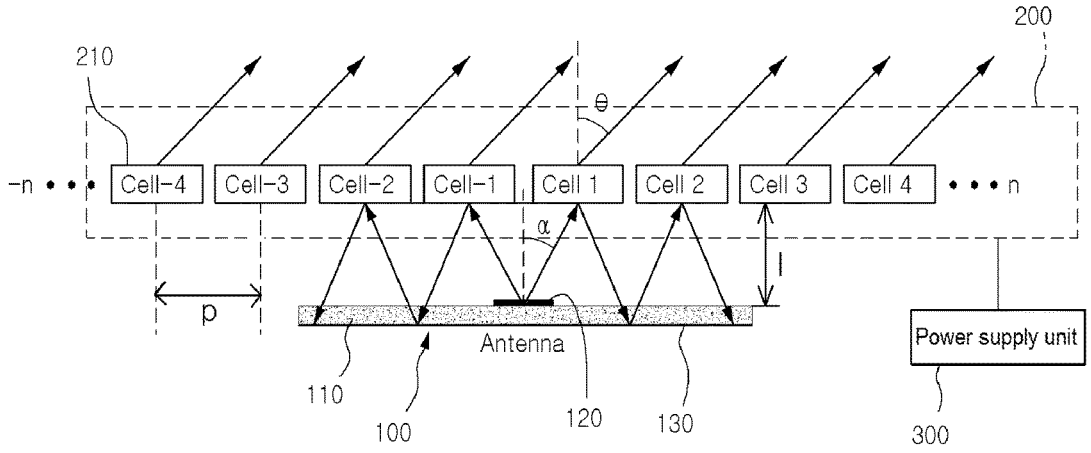
FIG. 1 is a schematic view of a beam steering system of a high-gain antenna using a paraelectric material according to an exemplary embodiment of the present disclosure.

Hereinafter, a beam steering system of a high-gain antenna using a paraelectric material according to an exemplary embodiment of the present disclosure will be described in detail with reference to the accompanying drawings. In the drawings, the thickness and dimensions of elements may be exaggerated for better comprehension and ease of description.

Further, the terminologies to be described below are ones defined in consideration of their function in the present disclosure and may be changed by the intention of a user or an operator, or a custom. Therefore, their definition should be made on the basis of the description of the present disclosure.

FIG. 1 is a schematic view of a beam steering system of a high-gain antenna using a paraelectric material according to an exemplary embodiment of the present disclosure.

Referring to FIG. 1, the beam steering system according to the exemplary embodiment of the present disclosure includes an antenna 100, a paraelectric material 200, and a power supply unit 300.

First, a printed circuit board 110, in which an antenna element 120 for transmitting radio waves is designed, and a ground plane 130 are each bonded to an upper surface and a lower surface of the antenna 100. The antenna 100 is a microstrip antenna, a type of planar antenna. In the antenna 100, conductive metal strips, which are boned to one surface of an insulating layer and are separated from the ground plane 130 by the insulating layer, are called microstrip lines. The microstrip lines can be minutely designed because they are fabricated as the printed circuit board 110.

The antenna 100 may have a flat circular shape or a flat polygonal shape. The antenna 100 is preferably separated from the paraelectric material 200 with a distance within a half wave of an operating frequency (that is, $\lambda/2$), and one or more antenna elements 120 may be diversely arranged on the printed circuit board 110.

The ground plane 130 may be formed by coating a conductive material with very prominent conductivity, such as copper (Cu) and aluminum (Al).

The paraelectric material 200 is a dielectric material which exhibits a centro-symmetric characteristic at a temperature higher than a transition temperature and don't have a characteristic of spontaneous polarization, and is divided into a plurality of cells 210. A pair of thin metallic conductor patches 211 are each adhered to upper and lower surfaces of each cell 210, and permittivity of the paraelectric material 200 is varied depending on a voltage to be applied to the metallic conductor patches 211.

All of the cells 210 have the same width and length and are arranged with the same interval therebetween.

The thickness of the metallic conductor patch 211 may be determined so that a reflection coefficient of the cell 210 converses on 1, or a pair of metallic conductor patches 211 may be each adhered to the upper and lower surfaces of each cell 210, between which a predetermined pattern is interposed.

In detail, since higher gain can be obtained as the reflection coefficient of the cell 210 approaches 1 from 0, the thickness of the metallic conductor patch 211 is determined so that the reflection coefficient of the cell 210 converses on 1, or the predetermined pattern (for example, a mesh pattern or a grid pattern) may be inserted.

Lastly, the power supply unit 300 supplies a voltage to a pair of the metallic conductor patches 211 adhered to the upper and lower surfaces of the cell 210 to face each other.

Figure 2:
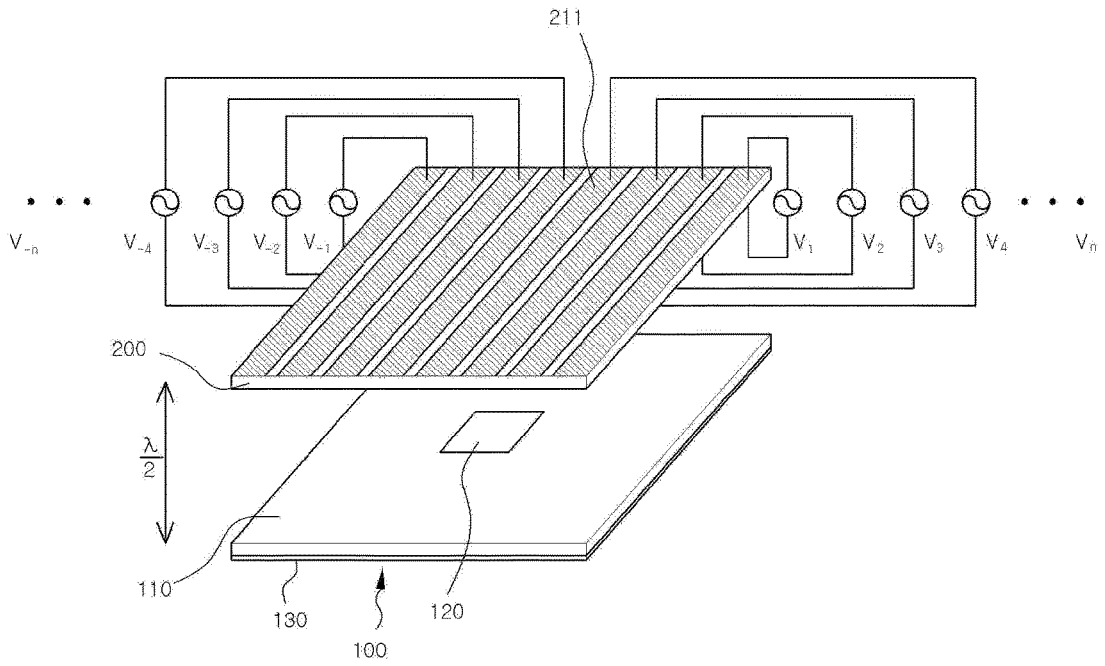
FIG. 2 is a schematic view of a paraelectric material for 2-dimensional beam steering according to an exemplary embodiment of the present disclosure.
Figure 3:
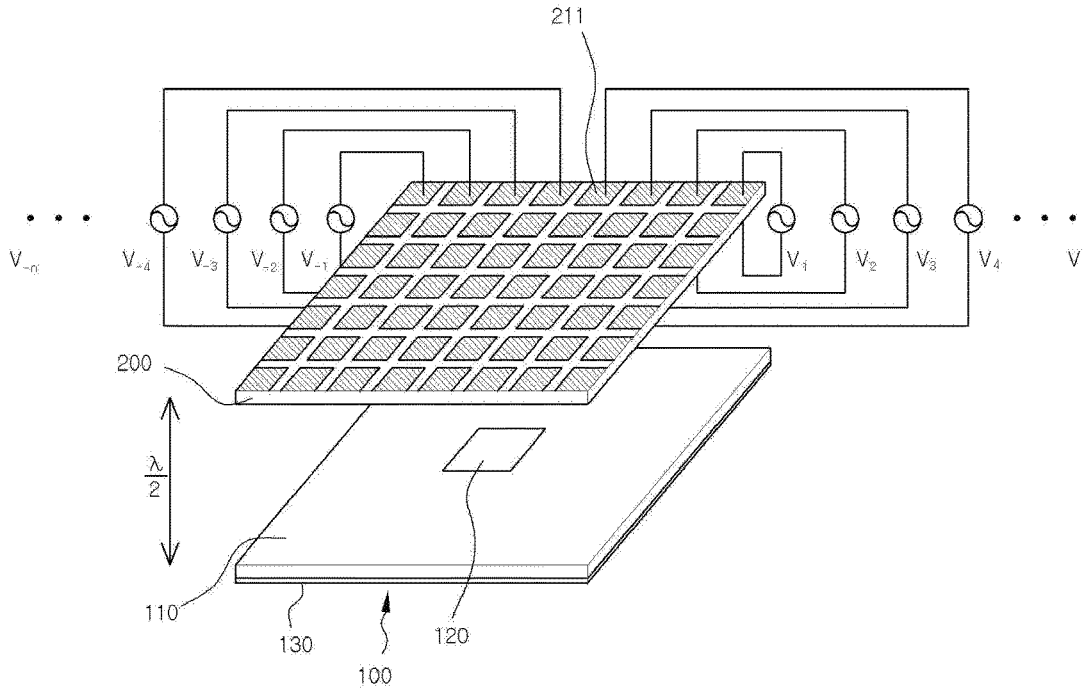
FIG. 3 is a schematic view of another paraelectric material for 3-dimensional beam steering according to another exemplary embodiment of the present disclosure.

FIG. 2 is a schematic view of a paraelectric material for 2-dimensional beam steering according to an exemplary embodiment of the present disclosure, and FIG. 3 is a schematic view of another paraelectric material for 3-dimensional beam steering according to another exemplary embodiment of the present disclosure.

In FIG. 2, the plurality of cells 210 are formed along a length direction, each separated apart from each other by the paraelectric material 200. Differently, the plurality of cells 210 may be formed like a lattice, each separated apart from each other by the paraelectric material 200, as shown in FIG. 3.

In detail, in the case in which the metallic conductor patches 211 are formed along the length direction as shown in FIG. 2, only 2-dimensional beam steering is possible, but in the case in which the metallic conductor patches 211 are formed in a lattice form as shown in FIG. 3, 3-dimensional beam steering becomes possible.

In this case, the metallic conductor patches 211 are preferably formed of silver (Ag). However, gold (Au), copper (Cu), etc. with prominent conductivity, giving no influence on the radio waves, may be also used for the formation of the metallic conductor patches 211.

Hereinafter, a method of calculating a transmission phase is described by using Equation 1 to Equation 5.

First, electric field intensity at a particular distance from the antenna 100 is expressed by the Equation 1.

$$E_T = \sum_{i=0}^{\infty} E_i \left( E_i = \prod_{n=1}^{i-1} R_n T_i e^{j(\phi_n + \psi_{Ti})} \right) \quad \text{<Equation 1>}$$

where $E_T$ is a transmitted electric field, i is an index of a transmitted wave (that is, the i-th cell 210), $R_n$ is the size of a reflection coefficient, $T_t$ is the size of a transmission coefficient of the i-th cell 210, j is a complex number, φn is a reflection phase of a partially reflective surface (PRS), and $\psi_{T1}$ is a transmission phase of the PRS. The reflection phase of the RPS at the i-th cell 210 is calculated by Equation 2.

$$\phi_i \begin{cases} (i-1)\left(-\frac{4\pi l \cos\alpha}{\lambda} + \pi\right) + \sum_{k=1}^{i-1} \psi_{RK} & i \geq 2 \\ (-i-1)\left(-\frac{4\pi l \cos\alpha}{\lambda} + \pi\right) + \sum_{k=-1}^{i-1} \psi_{RK} & i \geq 2 \end{cases}, \quad \text{<Equation 2>}$$

where $\phi_t$ is a reflection phase at the i-th cell 210, l is a distance between the antenna 100 and the PRS (that is, a distance between the antenna 100 and each cell 210), and α is a radio wave steering angle.

Transmission phase shift $\psi_1$ is expressed by Equation 3.

$$\psi_i = \phi_i + \psi_{Ti} \quad \text{<Equation 3>}$$

To control the direction of a beam, Equation 4 should be satisfied.

$$\psi_1 - \psi_{-1} = \frac{2\pi}{\lambda} p \sin\theta \quad \text{<Equation 4>}$$

$$\psi_1 + \psi_{-1} = \psi_N$$

$$\left(\psi_N = \frac{4\pi l}{\lambda} - \pi\right)$$

where $\psi_1$ and $\psi_{-1}$ are firstly arranged cells (Cell 1 and Cell-1 of FIG. 1) to the right and left from the center of the antenna 100, λ is a wavelength of the operating frequency, p is a distance between the center of a cell 210 and the center of the adjacent cell 210, and θ is a beam steering angle.

Transmission phases for a pair of firstly arranged cells (Cell 1 and Cell-1 of FIG. 1) and a pair of secondly arranged cells (Cell 2 and Cell-2 of FIG. 1) to the right and left from the center of the antenna 100 are calculated by Equation 5.

$$\begin{cases} \psi_{T1} = \psi_1 = \frac{\pi}{\lambda} p \sin\theta + \frac{\psi_N}{2} \\ \psi_{T-1} = \psi_{-1} = -\frac{\pi}{\lambda} p \sin\theta + \frac{\psi_N}{2} \end{cases}, \quad \text{<Equation 5>}$$

$$\begin{cases} \psi_{T2} = \frac{2\pi}{\lambda} p \sin\theta - \phi_2 + \psi_1 \\ \psi_{T-2} = -\frac{2\pi}{\lambda} p \sin\theta - \phi_2 + \psi_{-1} \end{cases}$$

where $\psi_{T1}$ and $\psi_{T-1}$ are transmission phases for the firstly arranged cells (Cell 1 and Cell-1 of FIG. 1) to the right and left from the center of the antenna 100, λ is a wavelength of the operating frequency of the antenna 100, p is a distance between the center of a cell 210 and the center of the adjacent cell 210, and θ is a beam steering angle (that is, an angle of a beam to be steered), $\psi_N$ is a sum of $\psi_1$ and $\psi_{-1}$, $\psi_{T2}$ and $\psi_{T-2}$ are transmission phases for the secondly arranged cells (Cell 2 and Cell-2 of FIG. 1) to the right and left from the center of the antenna 100, and $\phi_2$ and $\phi_{-2}$ are reflection phases for the secondly arranged cells (Cell 2 and Cell-2 of FIG. 1).

Transmission phases for the 2n+1-th ("n" is a natural number) arranged cells (that is, odd-numbered cells like Cell 3 and Cell-3 of FIG. 1) to the right and left from the center of the antenna 100 are set to be equal to the transmission phases $\psi_{T1}$ and $\psi_{T-1}$ for the firstly arranged cells (Cell 1 and Cell-1 of FIG. 1), and transmission phases for the 2n+2-th arranged cells (that is, even-numbered cells like Cell 4 and Cell-4 of FIG. 1) to the right and left from the center of the antenna 100 are set to be equal to the transmission phases $\psi_{T2}$ and $\psi_{T-2}$ for the secondly arranged cells (Cell 2 and Cell-2 of FIG. 1).

In this structure, if the distance between the antenna 100 and the paraelectric material 200 is short, influence of the firstly arranged cells (Cell 1 and Cell-1 of FIG. 1) and the secondly arranged cells (Cell 2 and Cell-2 of FIG. 1) becomes largest. Therefore, the firstly arranged cells and the secondly arranged cells may be repeatedly arranged in this case.

Figure 4:
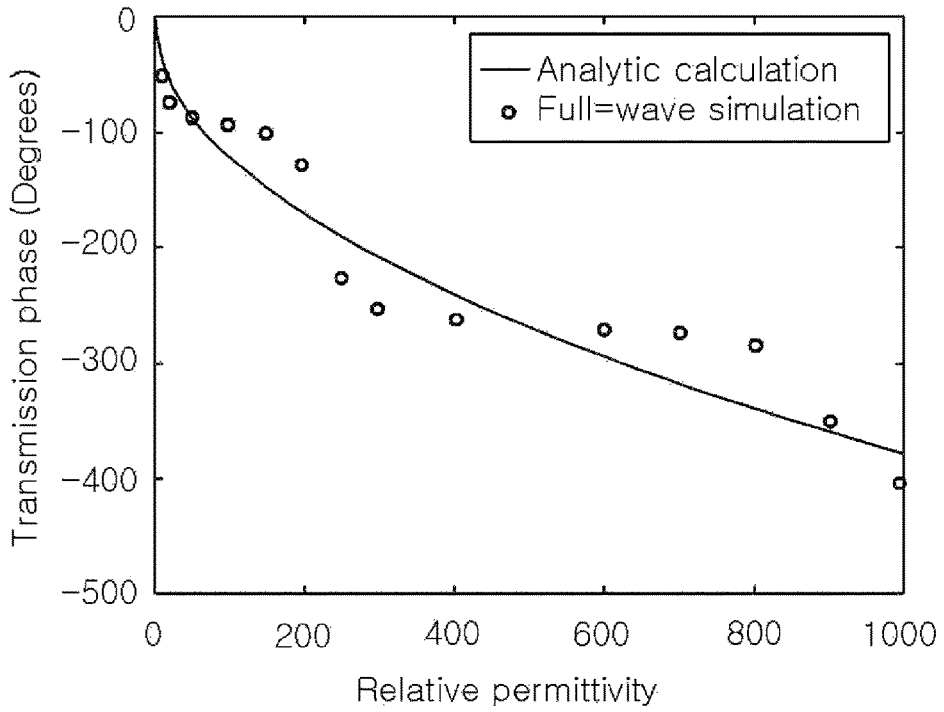
FIG. 4 is a graph showing an analysis of transmission phase versus relative permittivity of the paraelectric material, and results of simulations for propagation of radio waves.

FIG. 4 is a graph showing an analysis of the transmission phase versus the relative permittivity of the paraelectric material, and results of simulations for propagation of radio waves.

In detail, FIG. 4 is a graph of the transmission phase versus the relative permittivity when the operating frequency of the antenna 100 is 10 GHz, the thickness of the paraelectric material 200 is 1 mm, where the relative permittivity of the paraelectric material 200 is selected depending on the transmission phase calculated by Equation 1 to Equation 5. That is, the relative permittivity of each cell 210, satisfying the transmission phase calculated by Equation 5, can be selected from the graph of FIG. 4.

For example, in order for the beam to be steered toward the direction of 0° when the operating frequency of the antenna 100 is 10 GHz and the distance l between the antenna 100 and the PRS is 15 mm, 0 is first substituted for θ of Equation 5, and then the transmission phases $\psi_{T-2}$, $\psi_{T-1}$, $\psi_{T1}$, and $\psi_{T2}$ for the secondly arranged cell (Cell-2 of FIG. 1) and the firstly arranged cell (Cell-1 of FIG. 1) to the left from the center of the antenna 100, and the firstly arranged cell (Cell 1 of FIG. 1) and the secondly arranged cell (Cell 2 of FIG. 1) to the right from the center of the antenna 100 are respectively calculated by using Equation 5. The calculated transmission phases $\psi_{T-2}$, $\psi_{T-1}$, $\psi_{T1}$, and $\psi_{T2}$ are all 0, therefore it can be seen from FIG. 4 that the relative permittivity corresponding to the calculated transmission phases is about 5.

In addition, in order for the beam to be steered toward the direction of 30°, 30 is first substituted for θ of Equation 5, and then the transmission phases $\psi_{T-2}$, $\psi_{T-1}$, $\psi_{T1}$, and $\psi_{T2}$ for the secondly arranged cell (Cell-2 of FIG. 1) and the firstly arranged cell (Cell-1 of FIG. 1) to the left from the center of the antenna 100, and the firstly arranged cell (Cell 1 of FIG. 1) and the secondly arranged cell (Cell 2 of FIG. 1) to the right from the center of the antenna 100 are respectively calculated by using Equation 5. As a result, the calculated transmission phases $\psi_{T-2}$, $\psi_{T-1}$, $\psi_{T1}$, and $\psi_{T2}$ are −40, 0, −180, and 1220, respectively. Accordingly, it can be seen from FIG. 4 that the relative permittivities corresponding to the calculated transmission phases are 10, 5, 220, and 320.

Therefore, the power supply unit 300 calculates the transmission phase corresponding to the desired beam steering angle θ of the antenna 100, selects the relative permittivity of the paraelectric material 200 corresponding to the calculated transmission phase in the graph of FIG. 4, and supplies a voltage corresponding to the relative permittivity to at least one cell 210.

Figure 5:
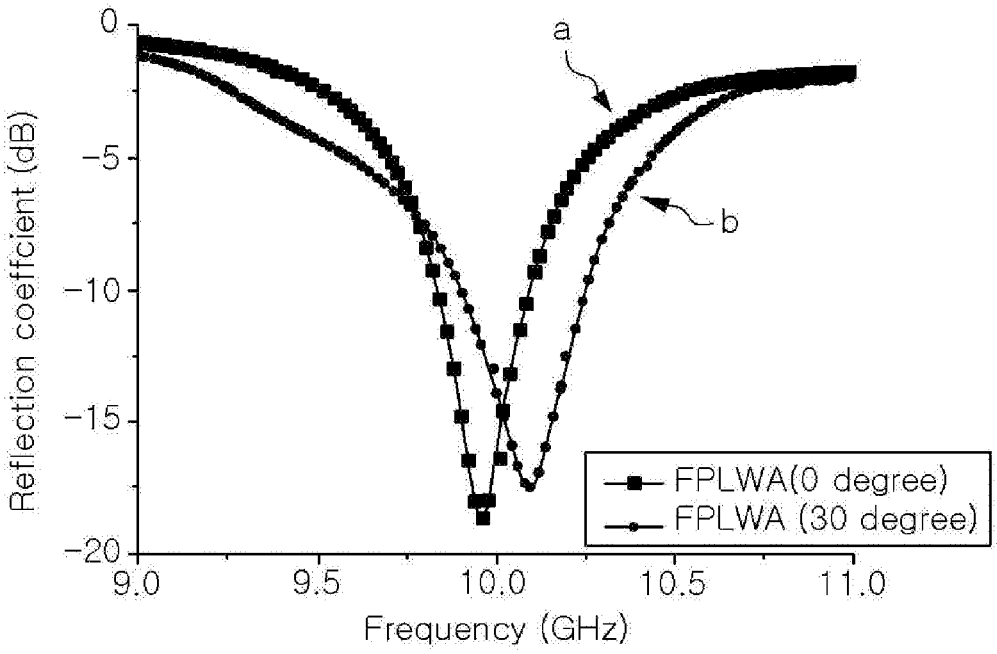
FIG. 5 is a graph comparing reflection coefficients of the antenna versus beam steering angles according to the exemplary embodiment of the present disclosure.

FIG. 5 is a graph comparing reflection coefficients of the antenna versus beam steering angles according to the exemplary embodiment of the present disclosure.

In FIG. 5, "a" shows the reflection coefficients when the beam steering angle is 0°, and "b" shows the reflection coefficients when the beam steering angle is 30°. In the beam steering using the paraelectric material 200, it can be seen that the operating frequency of the antenna 100 for the beam steering angles is rarely varied.

Figure 6:
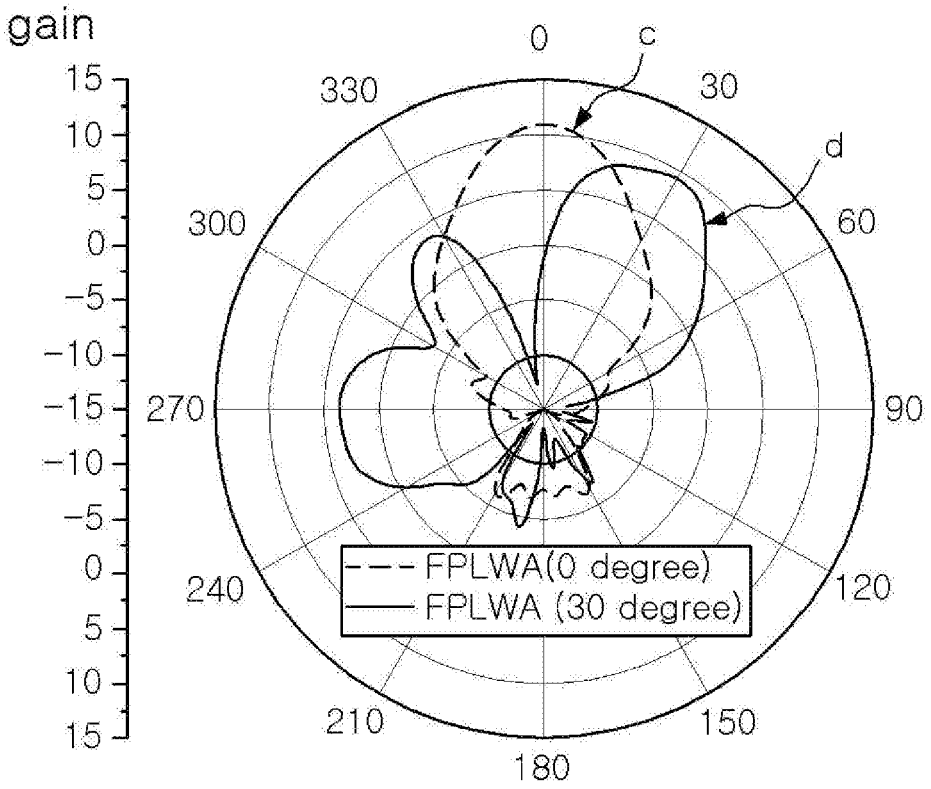
FIG. 6 is a graph showing radiation patterns of the antenna for the beam steering angles according to an exemplary embodiment of the present disclosure.

FIG. 6 is a graph showing radiation patterns of the antenna for the beam steering angles according to an exemplary embodiment of the present disclosure.

In the graph of FIG. 6, "c" shows the radiation pattern when the beam steering angle of 0° is given, and "d" shows the radiation pattern when the beam steering angle of 30° is given. At the beam steering angle of 0°, the gain is 10.8 dBi, and at 30°, the gain is 9.2 dBi. Accordingly, it can be seen that the gain of the antenna of the present disclosure is improved as compared to a single antenna having the gain of 6.8 dBi.

As described above, according to the exemplary embodiment of the present disclosure, since the relative permittivity can be controlled by using the paraelectric material whose permittivity varies depending on an applied voltage, the phase control of the transmitted radio wave becomes possible, and therefore beam steering of a desired direction can be accomplished. Further, the antenna gain can be enhanced by using the PRS.

Further, according to the exemplary embodiment of the present disclosure, depending on how the thin film shaped metallic conductor patches are arrayed, the 3-dimensional beam steering as well as the 2-dimensional beam steering becomes possible.

Furthermore, according to the exemplary embodiment of the present disclosure, since the beam steering utilizes the characteristics of the paraelectric material, a number of antennas are not required, and the power supply structure is simplified, thereby decreasing loss of power supply lines.

Example embodiments have been disclosed herein and although specific terms are employed, they are used and are to be interpreted in a generic and descriptive sense only and not for purpose of limitation. In some examples, as would be apparent to one of ordinary skill in the art as of the filing of the present application, features, characteristics and/or elements described in connection with a particular embodiment may be used singly or in combination with features, characteristics and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A beam steering system of a high-gain antenna, the system comprising:

an antenna having an antenna element designed in a printed circuit board, and a ground plane, the printed circuit board and the ground plane being adhered onto upper and lower surfaces of the antenna;

a paraelectric material being separated from the upper surface of the antenna with a predetermined distance and being divided into a plurality of cells;

a pair of thin metallic conductor patches being adhered to upper and lower surfaces of each of the plurality of cells, wherein thicknesses of the pair of thin metallic conductor patches are determined according to a reflection coefficient of each of the plurality of cells, and relative permittivity of the paraelectric material is varied according to an input voltage level applied to the determined thicknesses of the pair of thin metallic conductor patches; and a power supply unit configured to supply a voltage to the thin metallic conductor patches, wherein transmission phases for the plurality of cells are calculated by the following equation:

$$\begin{cases} \psi_{T1} = \psi_1 = \frac{\pi}{\lambda} p\sin\theta + \frac{\psi_N}{2} \\ \psi_{T-1} = \psi_{-1} = -\frac{\pi}{\lambda} p\sin\theta + \frac{\psi_N}{2} \end{cases}, \begin{cases} \psi_{T2} = \frac{2\pi}{\lambda} p\sin\theta - \phi_2 + \psi_1 \\ \psi_{T-2} = -\frac{2\pi}{\lambda} p\sin\theta - \phi_{-2} + \psi_{-1} \end{cases},$$

wherein $\psi_{T1}$ and $\psi_{T-1}$ are transmission phases for firstly arranged cells to the right and left from the center of the antenna, λ is a wavelength of a operating frequency of the antenna, p is a distance between the center of one cell and the center of the adjacent cell, and θ is a beam steering angle, $\psi_N$ is a sum of $\psi_1$ and $\psi_{-1}$, $\psi_{T2}$ and $\psi_{T-2}$ are transmission phases for secondly arranged cells to the right and left from the center of the antenna, and $\phi_2$ and $\phi_{-2}$ are reflection phases for the secondly arranged cells.

2. The system of claim 1, wherein the power supply unit is configured to calculate a transmission phase corresponding to a desired beam steering angle of the antenna, to select a relative permittivity of the paraelectric material by using the calculated transmission phase, and to supply a voltage corresponding to the selected relative permittivity to at least one cell of the plurality of cells.

3. The system of claim 1, wherein transmission phases for the 2n+1-th ("n" is a natural number) arranged cells to the right and left from the center of the antenna are set to be equal to the transmission phases $\psi_{T1}$ and $\psi_{T-1}$ for the firstly arranged cells, and transmission phases for the 2n+2-th arranged cells to the right and left from the center of the antenna are set to be equal to the transmission phases $\psi_{T2}$ and $\psi_{T-2}$ for the secondly arranged cells.

4. The system of claim 1, wherein the antenna has a flat circular shape or a flat polygonal shape and is separated from the paraelectric material with a distance within a half wave of the operating frequency, and wherein one or more antenna elements are arranged in the printed circuit board.

5. The system of claim 1, wherein the thin metallic conductor patches are formed of silver (Ag).

6. The system of claim 1, wherein each of the plurality of cells has the same length and width, and is separated from each other with the same interval therebetween.

7. The system of claim 1, wherein each of the plurality of cells, divided from the paraelectric material, is formed along a longitudinal direction or formed like a quadrangle.

8. The system of claim 1, wherein the pair of thin metallic conductor patches are each adhered to the upper and lower surfaces of each cell, and thicknesses of the pair of thin metallic conductor patches are set so that a reflection coefficient of each cell converses on 1, or a predetermined pattern is inserted therebetween of the pair of thin metallic conductor patches.

* * * * *